US012097941B1

(12) United States Patent
Ledford et al.

(10) Patent No.: US 12,097,941 B1
(45) Date of Patent: Sep. 24, 2024

(54) PORTABLE PEDAL SYSTEM FOR KAYAKS AND OTHER WATERCRAFT

(71) Applicants: Henry Ledford, High Point, NC (US); Michael D Ledford, High Point, NC (US); John Ledford Kirkpatrick, High Point, NC (US)

(72) Inventors: Henry Ledford, High Point, NC (US); Michael D Ledford, High Point, NC (US); John Ledford Kirkpatrick, High Point, NC (US)

( * ) Notice: Subject to any disclaimer, the term of this patent is extended or adjusted under 35 U.S.C. 154(b) by 219 days.

(21) Appl. No.: 17/716,055

(22) Filed: Apr. 8, 2022

Related U.S. Application Data

(60) Provisional application No. 63/174,073, filed on Apr. 13, 2021.

(51) Int. Cl.
*B63H 16/20* (2006.01)
*B63H 23/02* (2006.01)
*B63H 23/34* (2006.01)

(52) U.S. Cl.
CPC ..... *B63H 16/20* (2013.01); *B63H 23/34* (2013.01); *B63H 2016/202* (2013.01); *B63H 2023/0216* (2013.01); *B63H 2023/342* (2013.01)

(58) Field of Classification Search
CPC .. B63H 16/00; B63H 16/08; B63H 2016/085; B63H 16/12; B63H 16/14; B63H 16/18; B63H 16/20; B63H 2016/202; B63H 23/34; B63H 2023/342; B63H 2023/0216
USPC ..... 440/21, 26, 27, 29, 31, 32, 39
See application file for complete search history.

(56) References Cited

U.S. PATENT DOCUMENTS 4,511,338 A * 4/1985 Fanelli ..... B63B 32/56 441/74
6,905,379 B1 * 6/2005 Jackson ..... B63H 16/20 440/30
7,530,867 B2 * 5/2009 Jackson ..... B63H 16/20 440/28
8,342,897 B2 * 1/2013 Gater ..... B62M 17/00 440/27
9,533,746 B1 * 1/2017 Garrett ..... B63H 1/16

* cited by examiner

*Primary Examiner* — Daniel V Venne
(74) *Attorney, Agent, or Firm* — Ashley D. Johnson; Dogwood Patent and Trademark Law

(57) ABSTRACT

The portable pedal system for kayaks and other watercraft is a propulsion device. The portable pedal system for kayaks and other watercraft removably attaches to a vessel. The portable pedal system for kayaks and other watercraft is manually powered. The portable pedal system for kayaks and other watercraft comprises a belt drive, a transmission structure, and a vessel. The belt drive and the transmission structure removably attach to the vessel. The belt drive attaches to the transmission structure. A client manually powers the rotation of the belt drive. The rotation of the belt drive rotates the transmission structure which propels the vessel through the water.

8 Claims, 5 Drawing Sheets

PORTABLE PEDAL SYSTEM FOR KAYAKS AND OTHER WATERCRAFT

CROSS REFERENCES TO RELATED APPLICATIONS

This non-provisional application claims priority under 35 USC 119 (e) to U.S. provisional application US63174073 filed on Apr. 13, 2021, by the inventor: Henry Ledford. This non-provisional application claims United States provisional application U563174073 in its entirety.

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of propulsion systems for vessels, more specifically, a propeller based manual propulsion system that removably mounts to a vessel.

SUMMARY OF INVENTION

The portable pedal system for kayaks and other watercraft is a propulsion device. The portable pedal system for kayaks and other watercraft removably attaches to a vessel. The portable pedal system for kayaks and other watercraft is manually powered. The portable pedal system for kayaks and other watercraft comprises a belt drive, a transmission structure, and a vessel. The belt drive and the transmission structure removably attach to the vessel. The belt drive attaches to the transmission structure. A client manually powers the rotation of the belt drive. The rotation of the belt drive rotates the transmission structure which propels the vessel through the water.

These together with additional objects, features and advantages of the portable pedal system for kayaks and other watercraft will be readily apparent to those of ordinary skill in the art upon reading the following detailed description of the presently preferred, but nonetheless illustrative, embodiments when taken in conjunction with the accompanying drawings.

In this respect, before explaining the current embodiments of the portable pedal system for kayaks and other watercraft in detail, it is to be understood that the portable pedal system for kayaks and other watercraft is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the portable pedal system for kayaks and other watercraft.

It is therefore important that the claims be regarded as including such equivalent construction insofar as they do not depart from the spirit and scope of the portable pedal system for kayaks and other watercraft. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary of the following detailed description.

Figures 1, 2:
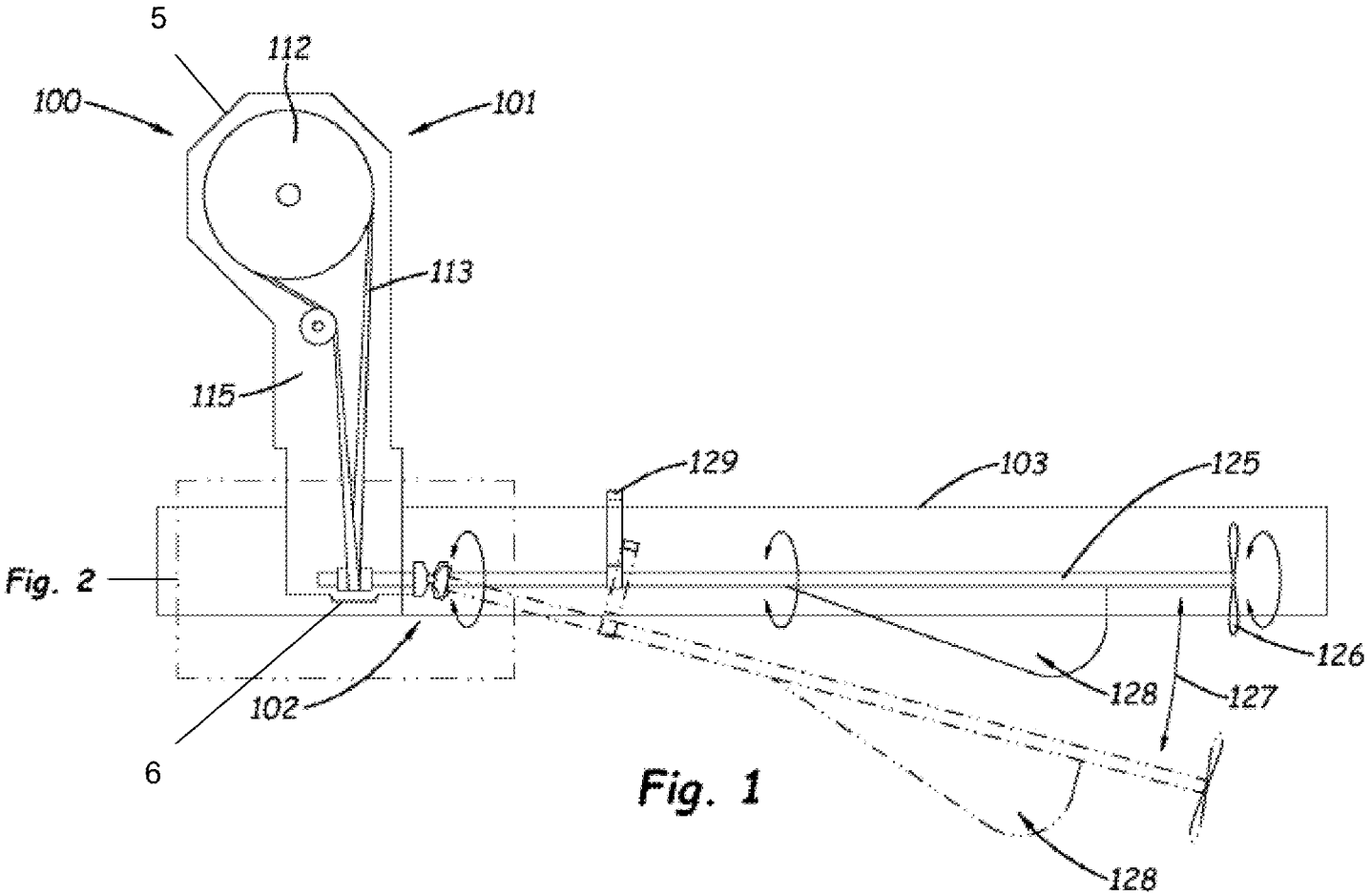
FIG. 1 is a side view of an embodiment of the disclosure that illustrates upper end 5 of the mounting structure and lower end 6 of the mounting structure.
FIG. 2 is a detail view of an embodiment of the disclosure.
Figure 2:
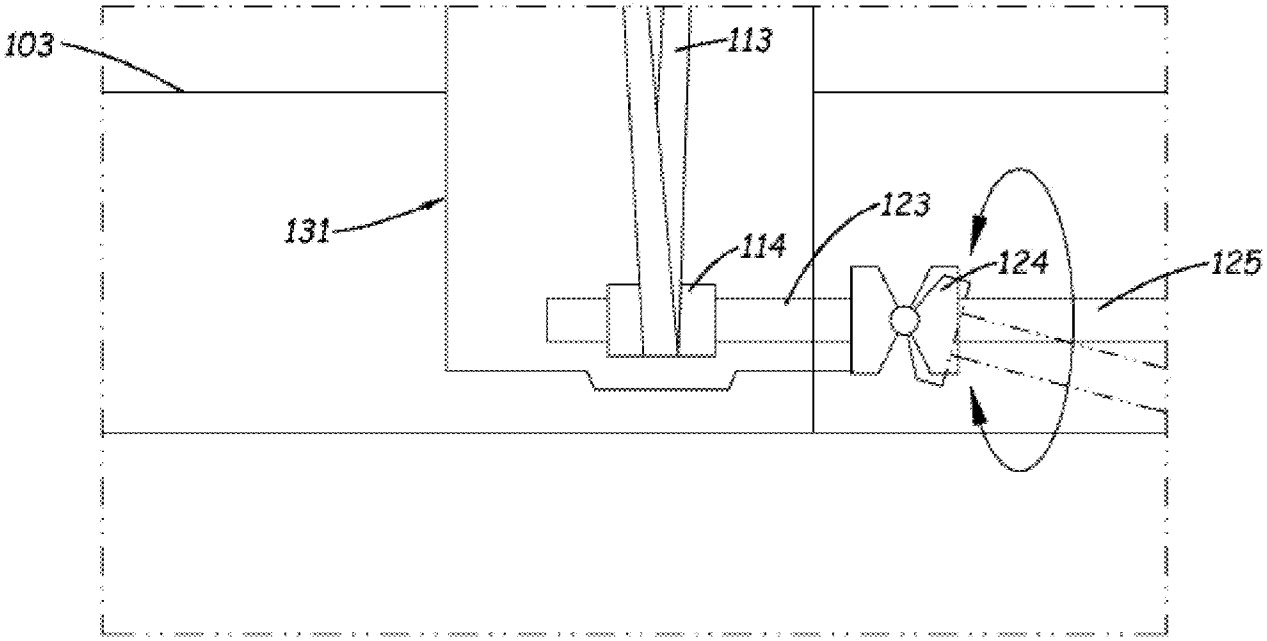
Figure 3:
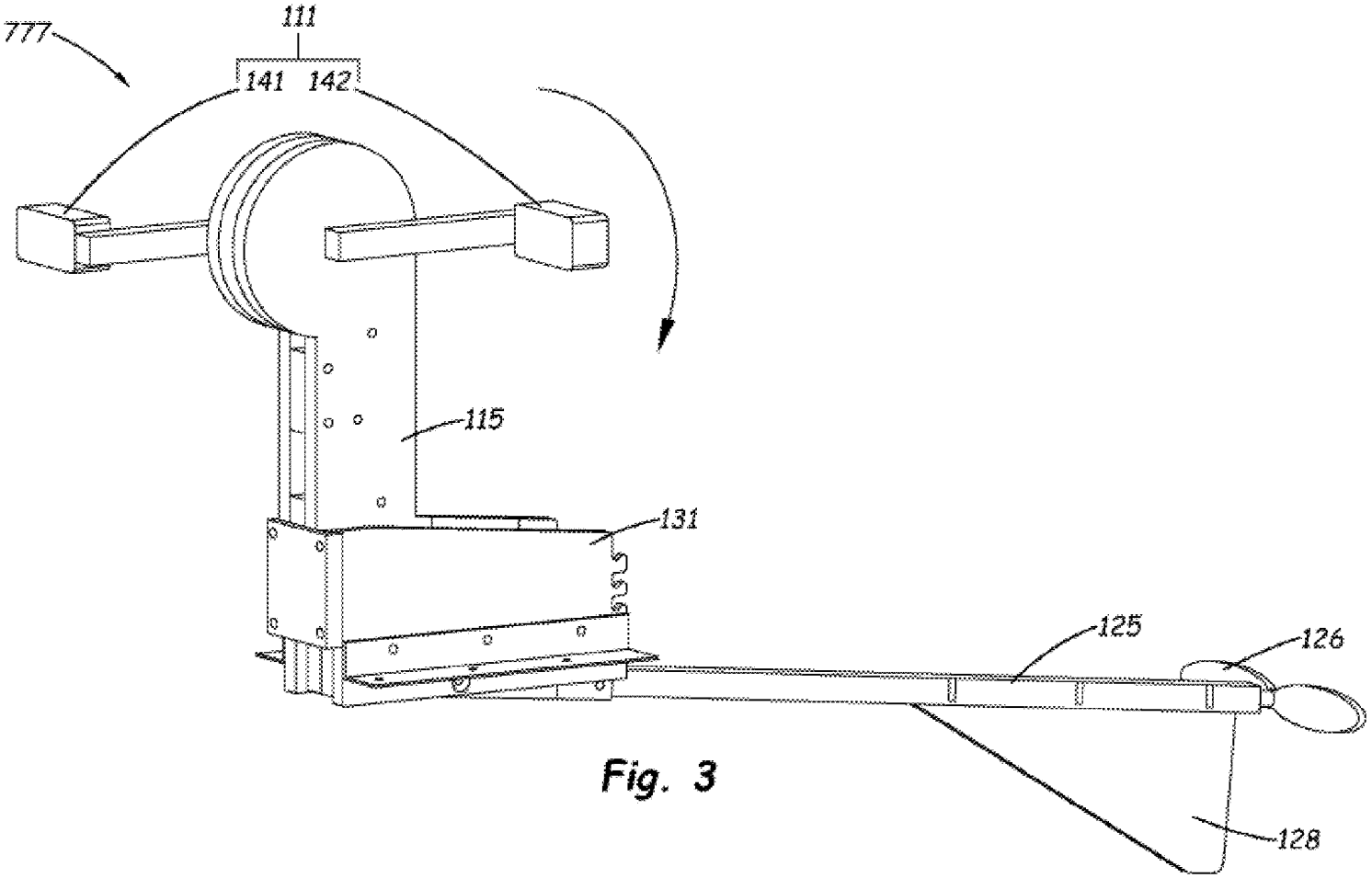
FIG. 3 is an in-use view of an embodiment of the disclosure.
Figure 4:
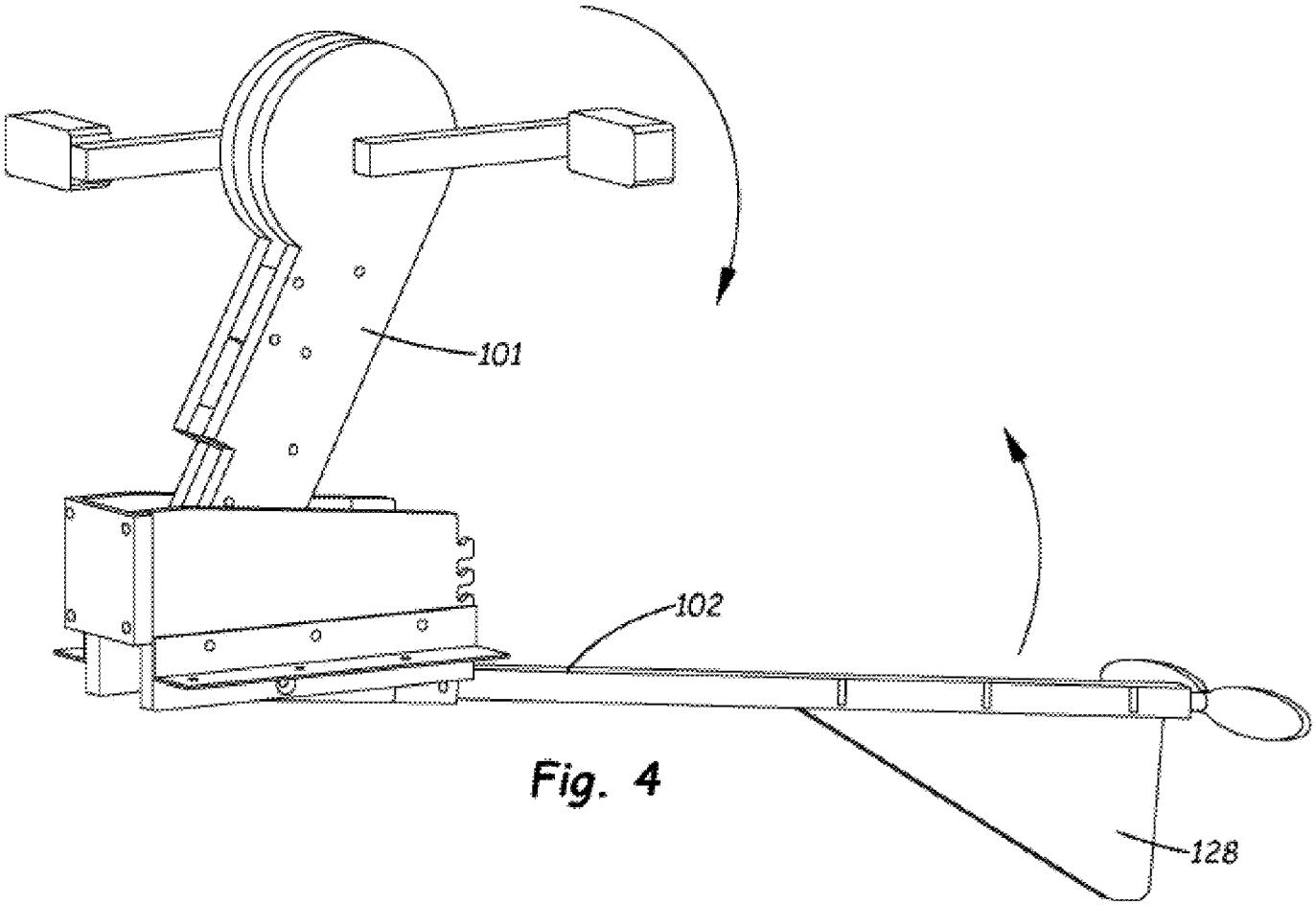
FIG. 4 is an in-use view of an embodiment of the disclosure.
Figure 5:
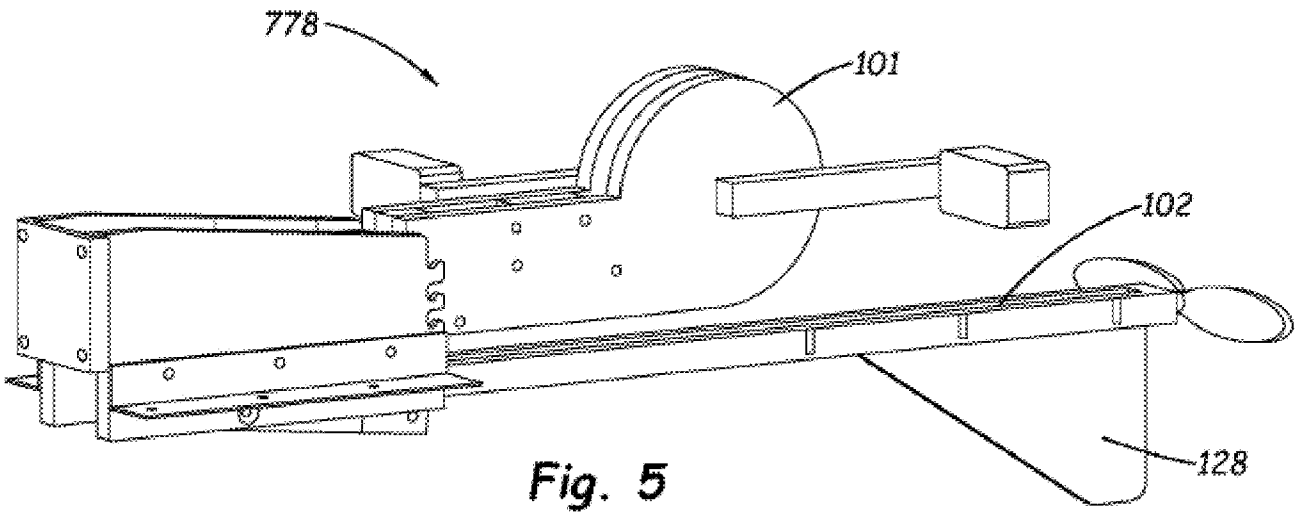
FIG. 5 is an in-use view of an embodiment of the disclosure.

Detailed reference will now be made to one or more potential embodiments of the disclosure, which are illustrated in FIGS. 1 through 5.

The portable pedal system for kayaks and other watercraft 100 (hereinafter invention) is a propulsion device. The invention 100 removably attaches to a vessel 103. The invention 100 is manually powered. The invention 100 comprises a belt drive 101, a transmission structure 102, and a vessel 103. The belt drive 101 and the transmission structure 102 removably attach to the vessel 103. The belt drive 101 attaches to the transmission structure 102. A client manually powers the rotation of the belt drive 101. The rotation of the belt drive 101 rotates the transmission structure 102, which propels the vessel 103 through the water. The client is defined elsewhere in this disclosure.

The vessel 103 is defined elsewhere in this disclosure. The vessel 103 further comprises a vessel mount 131. The vessel mount 131 is an anchor point that is formed in the vessel 103. The mounting structure 115 attaches the belt drive 101 and the transmission structure 102 to the vessel 103. The vessel mount 131 is formed with all the form factors and apertures necessary to allow for the operation of the belt drive 101 and the transmission structure 102.

The belt drive 101 is a mechanical device. The belt drive 101 is a rotating structure. The belt drive 101 is manually powered by a client. The belt drive 101 receives rotational energy from the client and transmits the rotating energy to the transmission structure 102. The client provides the motive forces necessary to rotate the transmission structure 102. The belt drive 101 removably attaches to the vessel mount 131.

The belt drive 101 comprises a drive mechanism 111, a drive pulley 112, a drive belt 113, a transfer pulley 114, and a mounting structure 115. The drive mechanism 111 attaches to the drive pulley 112. The drive belt 113 attaches the drive pulley 112 to the transfer pulley 114. The mounting structure 115 attaches the drive pulley 112 to the vessel mount 131. The mounting structure 115 attaches the transfer pulley 114 to the vessel mount 131. The transfer pulley 114 attaches the belt drive 101 to the transmission structure 102 such that the rotation of the transfer pulley 114 rotates the transmission structure 102.

The drive mechanism 111 is a mechanical structure. The drive mechanism 111 forms an interface with the client. The drive mechanism 111 is a rotating structure. The drive mechanism 111 attaches to the drive pulley 112 such that the drive mechanism 111 transfers the motive forces provided by the client into the rotation of the drive pulley 112. The drive mechanism 111 further comprises a first pedal 141 and a second pedal 142.

The first pedal 141 is a foot driven lever. The first pedal 141 attaches to the drive pulley 112 of the belt drive 101. The first pedal 141 transfers mechanical energy received from the foot of the client into energy used to rotate the drive pulley 112.

The second pedal 142 is a foot driven lever. The second pedal 142 attaches to the drive pulley 112 of the belt drive 101. The second pedal 142 transfers mechanical energy received from the foot of the client into energy used to rotate the drive pulley 112.

The drive pulley 112 is a gear. The drive pulley 112 attaches to the upper end of the mounting structure 115 such that the drive pulley 112 rotates freely relative to the mounting structure 115. The drive pulley 112 attaches to the drive belt 113 such that the rotation of the drive pulley 112 rotates the drive belt 113 around the drive pulley 112.

The drive belt 113 forms a loop that simultaneously wraps around the drive pulley 112 and the transfer pulley 114. Specifically, the drive belt 113 mechanically transfers the rotation of the drive pulley 112 to the transfer pulley 114 such that the transfer pulley 114 rotates with the drive pulley 112.

The transfer pulley 114 attaches to the lower end 6 of the mounting structure 115 such that the transfer pulley 114 rotates freely relative to the mounting structure 115. The transfer pulley 114 attaches to the drive belt 113 such that the rotation of the drive belt 113 by the drive pulley 112 rotates the transfer pulley 114.

The mounting structure 115 is a mechanical structure. The mounting structure 115 removably attaches to the vessel mount 131. The mounting structure 115 physically attaches to the drive pulley 112 such that the drive pulley 112 physically rotates relative to the mounting structure 115. The mounting structure 115 is a rotating structure. The mounting structure 115 rotates relative to the vessel 103 as well as the vessel mount 131 such that the axis of rotation of the drive pulley 112 rotates relative to the vessel mount 131 (see FIGS. 3-5). The mounting structure 115 can rotate from an upright position 777 (see FIG. 3) to a prone position 778 (see FIG. 5).

The mounting structure 115 physically attaches to the transfer pulley 114 such that the transfer pulley 114 physically rotates relative to the mounting structure 115. The mounting structure 115 forms a mechanical structure that removably attaches the drive pulley 112 to the transfer pulley 114 to form a single physical structure.

The transmission structure 102 is a mechanical device. The transmission structure 102 is a rotating structure. The transmission structure 102 forms a mechanical linkage with the belt drive 101. The transmission structure 102 receives rotational energy from the belt drive 101. The transmission structure 102 transmits the received rotational energy to mechanical energy used to propel the vessel 103. The transmission structure 102 removably attaches to the vessel mount 131.

The transmission structure 102 comprises a drive shaft 123, a universal joint 124, a propeller shaft 125, and a propeller 126. The drive shaft 123 attaches the belt drive 101 to the universal joint 124. The universal joint 124 removably attaches the drive shaft 123 to the propeller shaft 125. The propeller shaft 125 attaches the universal joint 124 to the propeller 126.

The drive shaft 123 is a prism-shaped structure. The drive shaft 123 is a rigid structure. The drive shaft 123 attaches to the transfer pulley 114 of the belt drive 101 such that the rotation of the transfer pulley 114 rotates the drive shaft 123. A congruent end of the prism structure of the drive shaft 123 attaches to the transfer pulley 114 such that the center axis of the drive shaft 123 aligns with the axis of rotation of the transfer pulley 114. The congruent end of the drive shaft 123 that is distal from the transfer pulley 114 removably attaches to the universal joint 124 such that the rotation of the drive shaft 123 rotates the universal joint 124.

The propeller shaft 125 is a prism-shaped structure. The propeller shaft 125 is a rigid structure. The propeller shaft 125 removably attaches to the universal joint 124 such that the rotation of the universal joint 124 rotates the propeller shaft 125. A congruent end of the prism structure of the propeller shaft 125 attaches to the universal joint 124 such that the center axis of the propeller shaft 125 aligns with the axis of rotation of the universal joint 124. The congruent end of the propeller shaft 125 that is distal from the universal joint 124 attaches to the propeller 126 such that the rotation of the universal joint 124 rotates the propeller 126.

The universal joint 124 removably attaches the drive shaft 123 to the propeller shaft 125. The universal joint 124 further comprises a drive cant 127. The universal joint 124 attaches the drive shaft 123 to the propeller shaft 125 such that the drive cant 127 between the center axis of the drive shaft 123 and the center axis of the propeller 126 shaft 125 is adjustable.

The universal joint 124 allows the mounting structure 115 to rotate relative to the vessel mount 131 and to the propeller shaft 125 in such a way as to allow both the mounting structure 115 and the propeller shaft 125 to be independently adjustable of each other for use while pedaling and to collapse into a more compact, portable, and transportable position as well as in the out of the way position if desired while the vessel is in use without the need of the propulsion system.

The universal joint 124 pivots, and also allows the weight of the shaft to automatically drop into the water when released by mechanical means 129. This allows the prop guard 128 to be attached to the transmission structure 102 with propeller 126 to be freely pushed up and over to a lesser cant by terrain or obstacles in the water contacted by the prop guard 128. This protects the propeller 126 without the assistance of the client while pedaling and without the client having to stop pedaling.

The mechanical means 129 is a glorified bracket that enables the propeller shaft 125 to be adjusted.

The propeller 126 is defined elsewhere in this disclosure. The rotation of the propeller 126 provides the motive forces necessary to propel the vessel 103.

The following definitions were used in this disclosure:

Align: As used in this disclosure, align refers to an arrangement of objects that are: 1) arranged in a straight plane of line; 2) arranged to give a directional sense of a plurality of parallel planes or lines; or, 3) a first line or curve is congruent to and overlaid on a second line or curve.

Belt: As used in this disclosure, a belt is a strip of flexible material that wraps around the lateral face of a prism-shaped object.

Belt Drive: As used in this disclosure, the belt drive is a transmission. The belt drive comprises a belt, a drive 111 pulley, one or more transfer pulleys, and a drive mechanism. The belt is threaded around that drive pulley and the one or more transfer pulleys to form a 100*p*. The drive mechanism attaches to the drive pulley such that the rotation of the drive mechanism rotates the belt around the one or more transfer pulleys. The rotation of the belt around the one or more transfer pulleys transfers the rotational energy from the drive mechanism to the one of more transfer pulleys such that each of the one or more transfer pulleys can rotate a load attached to the transfer pulley. The rotation of the belt can also twist 90 degrees to change the direction of rotational energy to rotate a load more efficiently without the need of additional gears or pulleys being used to transfer the direction in order to rotate a load requiring a directional change of transfer pulley in relation to the drive pulley. A transfer pulley that changes the direction of the track but does not rotate a load is called an idler pulley. A belt drive is a belt drive wherein: the belt can be replaced by a chain; and each of the drive pulley; and, b) each of the one or more transfer pulleys is a gear structure.

Cant: As used in this disclosure, a cant is an angular deviation from one or more reference lines (or planes) such as a vertical line (or plane) or a horizontal line (or plane).

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area of structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Center of Rotation: As used in this disclosure, the center of rotation is the point of a rotating plane that does not move with the rotation of the plane. A line within a rotating three-dimensional object that does not move with the rotation of the object is also referred to as an axis of rotation.

Chain: As used in this disclosure, a chain is a series of interlinked rings that form a cord like structure. Like a cord, a chain has tensile strength but is too flexible to provide compressive strength and is not suitable for use in pushing objects. The rings to form a chain are often formed from a metal.

Client: As used in this disclosure, a client is an individual who is designated to receive the services of the disclosure at bar.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Drive: As used in this disclosure, a drive is a mechanism or device that turns linear motion into rotational motion or rotational motion into linear motion.

Extension Structure: As used in this disclosure, an extension structure is an inert physical structure that is used to extend of bridge the reach between any two objects.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Gear: As used in this disclosure, a gear is a toothed wheel, cylinder, of other toothed mechanical element that is used to transmit motion, a change of speed, or a change of direction to a second toothed wheel, cylinder, or other toothed mechanical element.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Idler Bearing: As used in this disclosure, an idler bearing is a rotating structure that changes the direction of motion of a belt, chain, cord, or line. The idler bearing is also called an idler pulley and an idler gear.

Inferior: As used in this disclosure, the term inferior refers to a directional reference that is parallel to and in the same direction as the force of gravity when an object is positioned or used normally.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Loop: As used in this disclosure, a loop is the length of a first linear structure including, but not limited to, shafts, lines, cords, or webbings, that is: 1) folded over and joined at the ends forming an enclosed space; or, 2) curved to form a closed or nearly closed space within the first linear structure. In both cases, the space formed within the first linear structure is such that a second linear structure such as a line, cord of a hook can be inserted through the space formed within the first linear structure. Within this disclosure, the first linear structure is said to be looped around the second linear structure.

N-gon: As used in this disclosure, an N-gon is a regular polygon with N sides wherein N is a positive integer number greater than 2.

Negative Space: As used in this disclosure, negative space is a method of defining an object through the use of open or empty space as the definition of the object itself, of, through the use of open of empty space to describe the boundaries of an object.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, bl a lateral face of the prism structure that forms the pan. A semi-enclosed pan refers to a pan wherein the closed end of prism structure of the pan and/or a portion of the closed lateral faces of the pan are open.

Pedal: As used in this disclosure, a pedal is a foot operated lever that is used by the foot to power mechanical devices.

Perimeter: As used in this disclosure, a perimeter is one of more curved or straight lines that bounds an enclosed area on a plane or surface. The perimeter of a circle is commonly referred to as a circumference.

Pivot: As used in this disclosure, a pivot is a rod or shaft around which an object rotates or swings.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Propeller: As used in this disclosure, a propeller is a mechanical device with rotating blades that is used to create a flow of current of a liquid such as water.

Pulley: As used in this disclosure a pulley is a wheel with a grooved rim around which a cord or other form of rope, line, or cable) passes. The pulley is used to change the direction of a force applied to the cord.

Pyramid: As used in this disclosure, a pyramid is a three-dimensional shape that comprises a base formed in the shape of an N-gon (wherein N is an integer) with N triangular faces that rise from the base to converge at a point above the base. The center axis of a pyramid is the line drawn from the vertex where the N faces meet to the center of the N-gon base. The center axis of a right pyramid is perpendicular to the N-gon base. Pyramids can be further formed with circular or elliptical bases which are commonly referred to as a cone or an elliptical pyramid respectively. A pyramid is defined with a base, an apex, and a lateral face. The base is the N-gon shaped base described above. The apex is the vertex that defines the center axis. The lateral face is formed from the N triangular faces described above.

Reach: As used in this disclosure, reach refers to a span of distance between any two objects.

Rotation: As used in this disclosure, rotation refers to the cyclic movement of an object around a fixed point or fixed axis. The verb of rotation is to rotate.

Such As: As used in this disclosure, the term "such as" is a conjunction that relates a first phrase to a subsequent phrase. The term "such as" is used to introduce representative examples of structures that meet the requirements of the first phrase. As a first example of the use of the term "such as," the phrase: "the first textile attaches to the second textile using a fastener such as a hook and loop fastener" is taken to is suitable to use as the mean that a hook and loop fastener but is not meant to exclude the use of a zipper or a sewn seam. As a second example of the use of the term "such as," the phrase: "the chemical substance is a halogen such as chlorine or bromine" is taken to mean that either chlorine or bromine are suitable for use as the halogen but is not meant to exclude the use of fluorine or iodine.

Such That: As used in this disclosure, the term "such that" is a conjunction that relates a first phrase to a subsequent phrase. The term "such that" is used to place a further limitation or requirement to the first phrase. As a first example of the use of the term "such that," the phrase: "the door attaches to the wall such that the door rotates relative to the wall" requires that the attachment of the door allows for this rotation. As a second example of the use of the term "such that," the phrase: "the chemical substance is selected such that the chemical substance is soluble in water" requires that the selected chemical substance is soluble in water. As a third example of the use of the term "such that," the phrase: "the lamp circuit is constructed such that the lamp circuit illuminates when the lamp circuit detects darkness" requires that the lamp circuit: a) detect the darkness; and, b) generate the illumination when the darkness is detected.

Superior: As used in this disclosure, the term superior refers to a directional reference that is parallel to and in the opposite direction of the force of gravity when an object is positioned or used normally.

Supporting Surface: As used in this disclosure, supporting surface is a horizontal surface upon which an object is placed and to which the load of the object is transferred. This disclosure assumes that an object placed on the supporting surface is in an orientation that is appropriate for the normal or anticipated use of the object.

Thread: As used in this disclosure, to thread is a verb that refers to inserting a flexible prism structure through a track.

Track: As used in this disclosure, a track is a device that is used to control the path of motion of an object.

Transmission: As used in this disclosure, a transmission is a device that transmits the energy of motion from a first location to a second location.

Truncated: As used in this disclosure, a geometric object is truncated when an apex, vertex, of end is cut off by a line or plane.

Truncated Pyramid: As used in this disclosure, a truncated pyramid is a frustum that remains when the apex of a pyramid is truncated by a plane that is parallel to the base of the pyramid.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A portable pedal system comprising a belt drive, a transmission structure, and a vessel;

wherein the belt drive and the transmission structure removably attaches to the vessel;

wherein the belt drive attaches to the transmission structure, is a rotating structure, is manually powered, receives rotational energy and transmits a rotating energy to the transmission structure, and removably attaches to the vessel mount;

wherein the portable pedal system is a propulsion device that removably attaches to the vessel and is manually powered;

wherein the vessel comprises a vessel mount that is an anchor point attached to the vessel and that secures the belt drive and the transmission structure to the vessel;

wherein the belt drive is a manually powered mechanical rotating device that receives rotational energy and transmits the rotating energy to the transmission structure, removably attaches to the vessel mount, wherein the belt drive comprises a drive mechanism, a drive pulley, a drive belt, a transfer pulley, and a mounting structure, wherein the drive mechanism attaches to the drive pulley and the drive belt attaches the drive pulley to the transfer pulley;

wherein the transmission structure is a mechanical device and a rotating structure, forms a mechanical linkage with the belt drive, receives rotational energy from the belt drive, transmits the received rotational energy to mechanical energy used to propel the vessel, and removably attaches to the vessel mount;

wherein the mounting structure attaches the drive pulley to the vessel mount, and attaches the transfer pulley to the vessel mount;

wherein the transfer pulley attaches the belt drive to the transmission structure such that a rotation of the transfer pulley rotates the transmission structure; and wherein the transmission structure comprises a drive shaft, a universal joint, a propeller shaft, and a propeller, the drive shaft attaches the belt drive to the universal joint, the universal joint removably attaches the drive shaft to the propeller shaft, the propeller shaft attaches the universal joint to the propeller, and wherein the propeller shaft is able to pivot, allowing the propeller shaft to be lowered into and below a water line without the drive shaft, the universal joint, or the pulley drive having to go into or below the water line.

2. The portable pedal system according to claim 1, wherein the drive mechanism is a mechanical structure;

wherein the drive mechanism is a rotating structure;

wherein the drive mechanism attaches to the drive pulley such that the drive mechanism transfers motive forces into the rotation of the drive pulley;

wherein the drive mechanism further comprises a first pedal and a second pedal;

wherein the first pedal is a foot driven lever;

wherein the first pedal attaches to the drive pulley of the belt drive;

wherein the first pedal transfers received mechanical energy into energy used to rotate the drive pulley;

wherein the second pedal is a foot driven lever;

wherein the second pedal attaches to the drive pulley of the belt drive;

wherein the second pedal transfers received mechanical energy into energy used to rotate the drive pulley.

3. The portable pedal system according to claim 2 wherein the drive pulley attaches to an upper end of the mounting structure such that the drive pulley rotates freely relative to the mounting structure;

wherein the drive pulley attaches to the drive belt such that the rotation of the drive pulley rotates the drive belt around the drive pulley.

4. The portable pedal system according to claim 3 wherein the drive belt forms a loop that simultaneously wraps around the drive pulley and the transfer pulley;

wherein the drive belt mechanically transfers the rotation of the drive pulley to the transfer pulley such that the transfer pulley rotates with the drive pulley.

5. The portable pedal system according to claim 4 wherein the transfer pulley attaches to a lower end of the mounting structure such that the transfer pulley rotates freely relative to the mounting structure;

wherein the transfer pulley attaches to the drive belt such that the rotation of the drive belt by the drive pulley rotates the transfer pulley.

6. The portable pedal system according to claim 5 wherein the mounting structure is a mechanical structure;

wherein the mounting structure removably attaches to the vessel mount;

wherein the mounting structure physically attaches to the drive pulley such that the drive pulley physically rotates relative to the mounting structure;

wherein the mounting structure is a rotating structure;

wherein the mounting structure rotates relative to the vessel such that an axis of rotation of the drive pulley rotates relative to the vessel mount;

wherein the mounting structure rotates relative to the vessel mount from an upright position to a prone position;

wherein the mounting structure physically attaches to the transfer pulley such that the transfer pulley physically rotates relative to the mounting structure;

wherein the mounting structure forms a mechanical structure that removably attaches the drive pulley to the transfer pulley to form a single physical structure.

7. The portable pedal system according to claim 6 wherein the drive shaft is a rigid structure;

wherein the drive shaft attaches to the transfer pulley of the belt drive such that the rotation of the transfer pulley rotates the drive shaft;

wherein a congruent end of the drive shaft attaches to the transfer pulley such that a center axis of the drive shaft aligns with the axis of rotation of the transfer pulley;

wherein the congruent end of the drive shaft that is distal from the transfer pulley removably attaches to the universal joint such that the rotation of the drive shaft rotates the universal joint.

8. The portable pedal system according to claim 7 wherein the propeller shaft is a rigid structure;

wherein the propeller shaft removably attaches to the universal joint such that the rotation of the universal joint rotates the propeller shaft;

wherein a congruent end of the propeller shaft attaches to the universal joint such that the center axis of the propeller shaft aligns with the axis of rotation of the universal joint;

wherein the congruent end of the propeller shaft that is distal from the universal joint attaches to the propeller such that the rotation of the universal joint rotates the propeller;

wherein the universal joint is a locking universal joint;

wherein the universal joint removably attaches the drive shaft to the propeller shaft;

wherein the universal joint further comprises a drive cant;

wherein the universal joint attaches the drive shaft to the propeller shaft such that the drive cant between the center axis of the drive shaft and the center axis of the propeller shaft is adjustable;

wherein the rotation of the propeller provides the motive forces necessary to propel the vessel.

* * * * *